US007315006B2

(12) United States Patent
Houck, III et al.

(10) Patent No.: US 7,315,006 B2
(45) Date of Patent: Jan. 1, 2008

(54) FUSE BLOCK WITH IMPROVED UNIDIRECTIONAL OPERATOR

(75) Inventors: Theodore John Houck, III, Milwaukee, WI (US); Jie Ning, Shorewood, WI (US); James Peter Miller, Waukesha, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 174 days.

(21) Appl. No.: 11/343,405

(22) Filed: Jan. 31, 2006

(65) Prior Publication Data

US 2007/0175745 A1 Aug. 2, 2007

(51) Int. Cl.
*H01H 3/20* (2006.01)
*G05G 5/06* (2006.01)

(52) U.S. Cl. ..... 200/331; 200/50.05; 74/527; 74/575

(58) Field of Classification Search ..... 74/504, 74/507, 527, 531, 575, 577 M; 200/17 R, 200/43.04, 43.08, 43.11, 564, 565, 334, 336, 200/329–331, 50.12, 50.13, 50.15, 50.01, 200/50.07, 50.05
See application file for complete search history.

(56) References Cited

U.S. PATENT DOCUMENTS

| | | | | |
|---|---|---|---|---|
| 4,146,764 | A * | 3/1979 | Wilson | 200/400 |
| 4,183,260 | A * | 1/1980 | Wagner et al. | 74/575 |
| 4,263,486 | A * | 4/1981 | Taylor | 200/17 R |
| 6,578,447 | B1 * | 6/2003 | Fraser | 74/527 |
| 6,604,440 | B2 * | 8/2003 | Wessel et al. | 74/502.2 |
| 6,989,499 | B2 * | 1/2006 | Bortolloni et al. | 200/50.05 |
| 7,015,403 | B2 * | 3/2006 | Houck et al. | 200/50.05 |
| 7,071,427 | B2 * | 7/2006 | Houck et al. | 200/50.05 |

* cited by examiner

*Primary Examiner*—Michael A Friedhofer
(74) *Attorney, Agent, or Firm*—Quarles & Brady LLP; Alexander R. Kuszewski

(57) ABSTRACT

A ball ratchet mechanism suitable for use with an electrical disconnect employs a track and drive surface that engage the ball so as to capture it without significant shear force being applied to ridges of the track. In this way, the shape of the track can be optimized for smooth ratcheting action without the risk of high torques shearing track ridges.

15 Claims, 13 Drawing Sheets

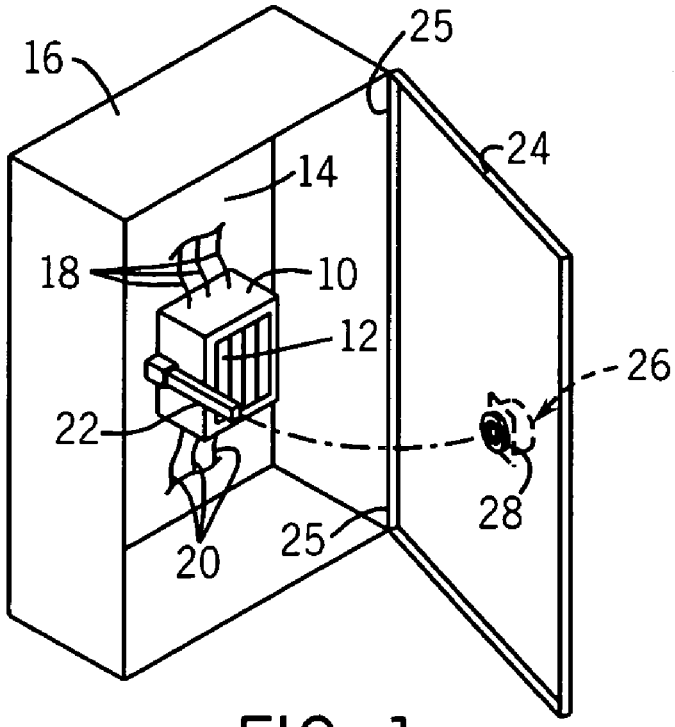
FIG. 1
PRIOR ART
FIG. 2
PRIOR ART
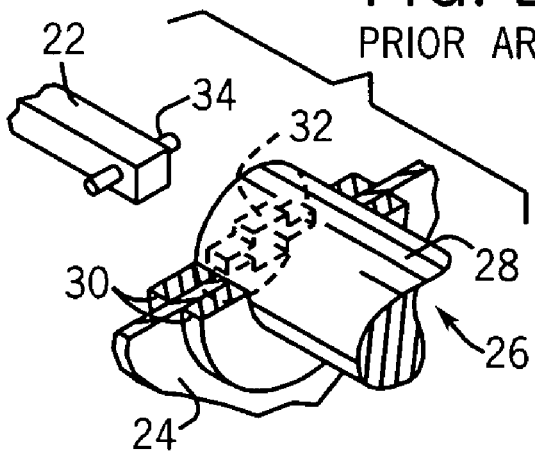

FUSE BLOCK WITH IMPROVED UNIDIRECTIONAL OPERATOR

CROSS-REFERENCE TO RELATED APPLICATIONS

—

STATEMENT REGARDING FEDERALLY SPONSORED RESEARCH OR DEVELOPMENT

—

BACKGROUND OF THE INVENTION

The present invention relates to a unidirectional mechanism useful in electrical disconnects and in particular to a unidirectional mechanism providing smooth rotation and high strength.

Referring to FIG. 1, a disconnect in the form of a standard fuse block 10 of the prior art may receive fuse cartridges 12 along its front face and may attach at its rear face to the rear wall 14 of a metal cabinet 16.

Input terminals along the top of fuse block 10 may receive wires 18 which connect independently to one side of each fuse cartridge 12, the latter which interconnect wires 18 to wires 20 attached to output terminals along the bottom of the fuse cartridge 12. Wires 18, for example, may be connected to a source of three-phase power and wires 20, for example, may be connected to a motor or other piece of equipment.

Fuse block 10 may be activated to electrically disconnect wires 18 from the respective fuse cartridges 12. The fuse block 10 may be controlled by a rotary shaft 22 along one side of the fuse block 10 and extending in an orientation perpendicular to the rear wall 14 of cabinet 16 toward an open face of the cabinet.

The open face of the cabinet may be covered by a door 24 attached by hinges to one side of the cabinet 16. Door 24 may support a captively mounted rotary knob 26 having an inwardly extending connector 28.

Referring now to FIG. 2, knob 26 may include connector 28 that extends inwardly through an opening in the door 24. Connector 28 includes retaining flanges 30 for retaining it rotatably within that opening.

When door 24 is closed about the cabinet 16, connector 28 of the knob 26 engages the outermost end of rotary shaft 22, thereby allowing rotary shaft 22 to be operated by knob 26 when door 24 is closed on cabinet 16. Specifically, an inwardly facing end of connector 28 may include a keyway 32 receiving a rectangular end of rotary shaft 22 and a pin 34 extending perpendicularly through the rotary operator. Turning knob 26, in turn, rotates shaft 22 to electrically disconnect or connect power to wires 20.

Referring again to FIG. 1, knob 26 allows disconnection of power to wires 20 when the door 24 on the cabinet 16 is closed. However, when door 24 is open, rotary shaft 22 is exposed, thereby enabling power to be inadvertently reconnected by counter rotation the shaft 22.

One apparatus for preventing the reconnection of power while the door is open includes a mechanism that is connected to the exterior of fuse block 10 as described in U.S. Pat. No. 6,700,081, entitled "Fuse Block With Door Sensing Rotary Disconnect" assigned to the assignee of the present invention and hereby incorporated by reference. The mechanism enables knob rotation to connect and disconnect the power when the door is closed, and further prevents inadvertent counter rotation of the knob to reconnect the power when the door is open. While this apparatus is suitable for its intended purpose, the mechanism requires modification of an existing fuse block.

U.S. Pat. No. 6,881,909, entitled: "Fuse Block With Integral Door Sensing Rotary Disconnect" also assigned to the assignee of the present invention and hereby incorporated by reference, describes a handle, accessible within the door, is open and incorporating a uni-directional mechanism that allows disconnecting of power by turning the handle, and the block reconnecting of power by turning the handle in the opposite direction until a secondary operation of pulling the handle out is performed.

The unidirectional mechanism employed in the above inventions uses a set of pawl teeth that engage a slotted disk. U.S. Application 2005/0040019 entitled: "Fuse Block with Integral Door Sensing Rotary Disconnect", also assigned to the assignee of the present invention and hereby incorporated by reference, describes a unidirectional mechanism employing balls fitting between a scalloped track and inner drive providing smooth relative rotation between the drive and the track in one direction, and a positive rotational locking of the drive in the other direction.

BRIEF SUMMARY OF THE INVENTION

The present invention provides an improved uni-directional mechanism using balls selectively locking a track and drive for one direction of motion. The present inventors have recognized that control of the contact surfaces to the ball, ideally to be parallel tangents, can significantly reduce shear force on the ridges of the track, preventing shearing of the ridges under high torque. By reducing shear forces, the ridges may be shaped for improved passage of the balls when locking of the track and drive is not required.

Specifically then, in one embodiment, the invention provides a ball ratchet having an inner element rotatable within an outer element. A first substantially circular track is formed in one of the inner and outer elements providing a set of ridges extending radially toward an other of the inner and outer elements. A driving face is formed in the other of the inner and outer elements and facing the circular track. At least one spring-loaded ball fits between the driving face and the circular track so that (1) rotary force between the inner and outer elements in a first direction causes movement of the spring-loaded ball to compress its spring allowing the ball to navigate between the ridges, and the driving face to permit relative movement of the inner and outer elements, and (2) rotary force between the inner and outer elements in a second direction causes capture of the spring-loaded ball between the circular track, and the driving face locking the inner and outer elements for joint movement. A vector of force by the ball on the circular track does not pass through a ridge so that a shearing of the ridge would permit rotation in the second direction.

Thus it is one object of at least one embodiment of the invention to provide a ball ratchet mechanism with improved torsional strength for a given ridge depth. It is another object of at least one embodiment of the invention to relax the requirements of ridge height.

The tangent lines to contract points of the ball on the inner and outer elements when the ball is captured between the inner and outer elements may be parallel.

It is thus another object of at least one embodiment of the invention to eliminate, in one embodiment, force components along the track surface such as would promote shear of the ridges.

The circular track may be on the outer element.

Thus it is one object of at least one embodiment of the invention to provide a proportionally larger track length to provide improved manufacture and ridge size.

The outer element may be a handle graspable by a human operator to turn the outer element, and the inner element may include a keyed bore for receiving a shaft.

It is thus another object of at least one embodiment of the invention to provide a uni-directional mechanism suitable for use with a disconnect.

The ridges present continuously rounded surfaces.

Thus it is another object of at least one embodiment of the invention to provide an improved ridge shape reducing resistance and noise when the ball moves along the track.

The invention may provide two spring-loaded balls symmetrically located about the inner element.

Thus it is another object of at least one embodiment of the invention to provide a sharing of force over multiple balls further reducing the shear force on the track ridges.

The vector of force by the ball on the circular track does not pass into space between the first and second elements.

It is thus another object of at least one embodiment of the invention to prevent forces directed against the ridges that would promote a shearing of the cantilevered profile of the ridges.

These particular objects and advantages may apply to only some embodiments falling within the claims and thus do not define the scope of the invention.

BRIEF DESCRIPTION OF THE DRAWINGS

FIG. 1 is a perspective view of a prior art fuse block described above and mounted to the rear of a cabinet and having a forwardly extending rotary disconnect operator that may be received by a door-mounted handle when the cabinet door is closed;

FIG. 2 is a fragmentary view of the door-mounted handle immediately before engagement with the rotary disconnect operator as known in the prior art;

DETAILED DESCRIPTION OF THE PREFERRED EMBODIMENT

Figure 4:
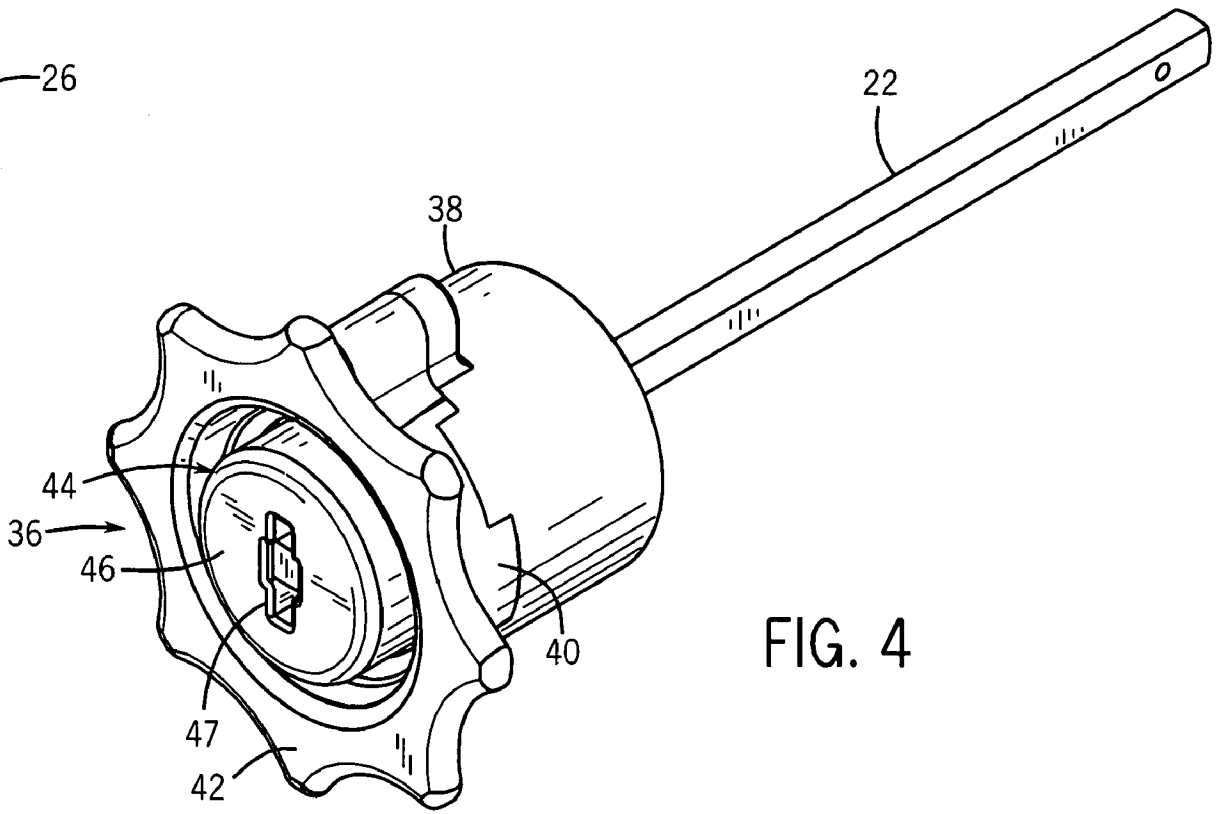
FIG. 4 is a perspective view of the operator assembly illustrated in FIG. 3 that receives the shaft.
Figure 3:
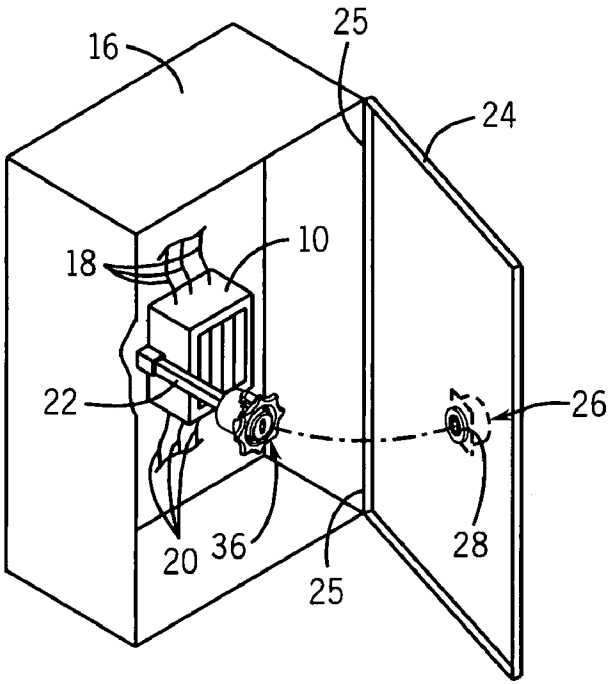
FIG. 3 is a perspective view of a fuse block mounted to the rear of a cabinet and having a forwardly extending rotary disconnect shaft extending through an operator assembly having a handle constructed in accordance with the preferred embodiment.

Referring to FIGS. 3 and 4, the present invention modifies the fuse block 10 described above by mounting an operator assembly 36 to the axially outer end of a rotary shaft 22 coupled to the fuse block 10. While an exemplary embodiment of the present invention is described of controlling electrical current through fuse block, it should be appreciated that the present invention is applicable to any electrical disconnect, including fuses, circuit breakers, and traditional switches.

Operator assembly 36 extends generally axially, and interfaces with door knob 26 and, in particular, with connector 28. Operator assembly 36 is thus operable by a user to connect power to fuses on fuse block 10, and disconnect power from fuse block 10. Operator assembly 36 preferably comprises a plastic, though one skilled in the art will recognize that any material suitable to withstand the stress and strain experienced during operation falls within the scope of the present invention.

Figure 5:
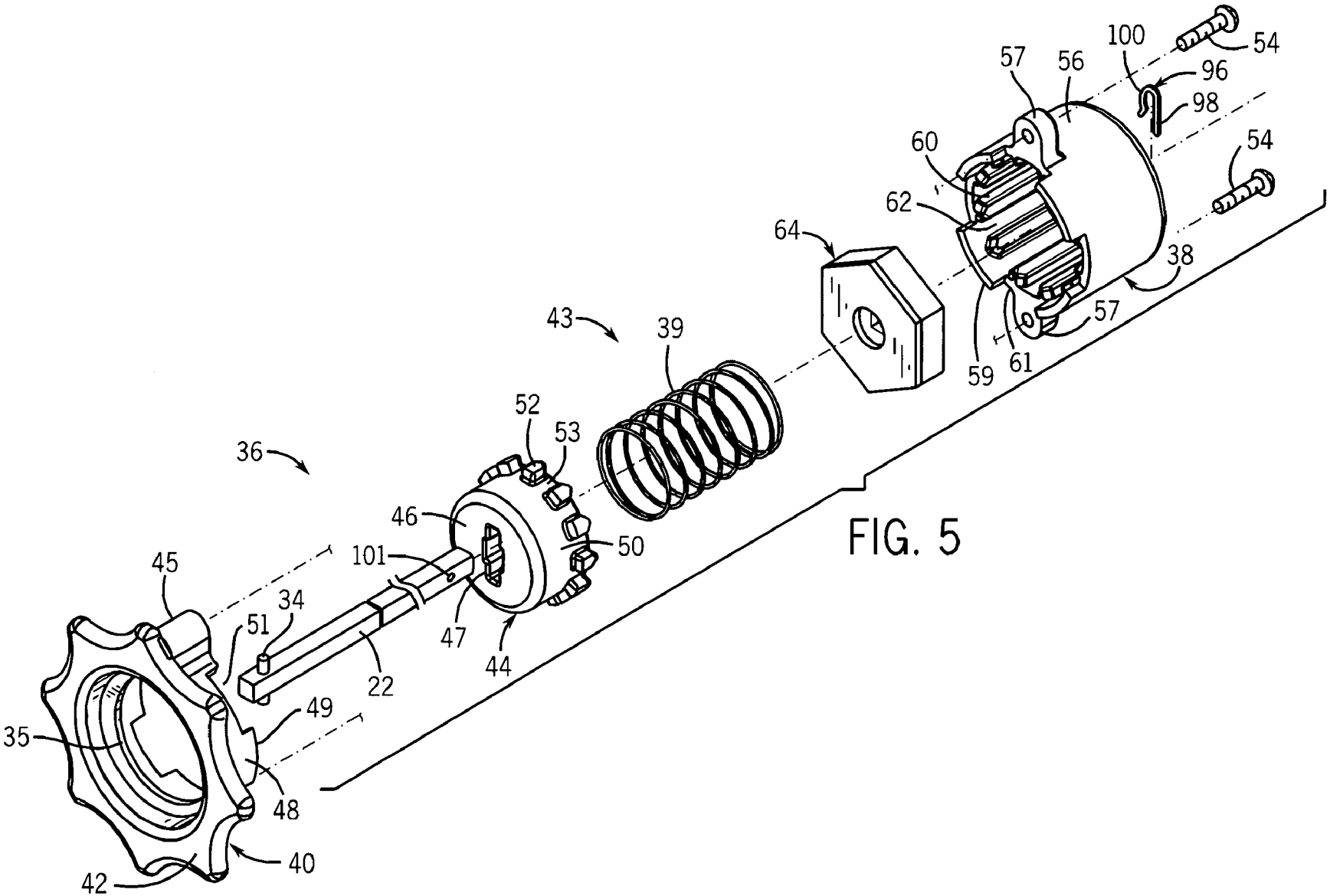
FIG. 5 is an assembly view of the operator assembly illustrated in FIG. 3

Referring now to FIG. 5 in particular, one exemplary embodiment of operator assembly 36 is formed from a housing including an inner shell 38 fastened to an outer handle that retains a uni-directional coupling mechanism 64, a clutch 43 including a spring 39, and an inner cylindrical hub 44. Operator assembly 36 is carried by the axially outer end of shaft 22.

Figure 11:
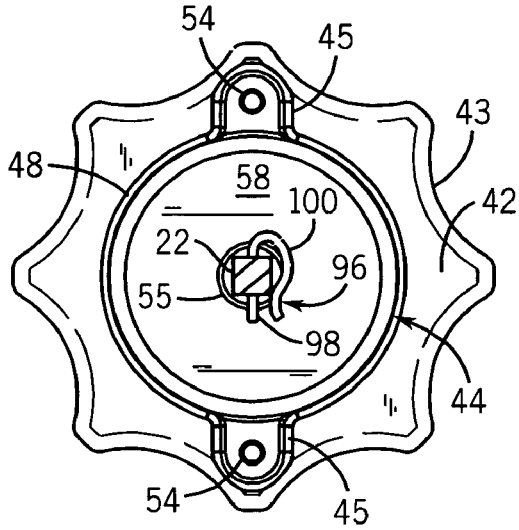
FIG. 11 is a bottom view of the operator assembly illustrated in FIG. 3.

Referring also to FIG. 11, inner shell 38 includes an annular cup 56 open at its axially outer end and closed at its axially inner end by an end face 58. A circular aperture 55 extends axially through face 58, and is centrally disposed to pass shaft 22. The diameter of aperture 55 is greater than the largest cross-sectional dimension across shaft 22 such that rotation of shell 38 does not cause face 58 to impart rotational forces onto shaft 22. A clip 96 is provided that includes a pin 98 and a fastener clamp 100. Pin 98 is inserted through an aperture 101 extending radially through shaft 22, and is retained by clamp 100 which applies radial pressure against shaft 22. Clip 96 abuts face 58 and, accordingly, the axial location of aperture 101 determines the position of operator assembly 36 with respect to shaft 22.

A plurality of beveled ribs 60 extends axially along the radially inner surface of annular cup 56. Ribs 60 are equally spaced circumferentially about annular cup 56 to define a plurality of interposed recesses 62. A plurality of radially spaced teeth 59 extend axially out from the outer end of annular cup 56, and are equally spaced circumferentially about annular cup 56 to define a corresponding plurality of interposed recesses 61. A pair of opposing mounting flanges 57 extends radially out from the axially outer end of annular cup 56, and includes a pair of apertures sized to receive corresponding screws 54.

Referring now to FIGS. 5 and 14-16, a uni-directional coupling mechanism 64 is provided in the form of a ratchet assembly that enables uni-directional operation to disconnect power from fuse block 10. Ratchet assembly 64 includes a bearing cup 66 having a hexagonal outer wall 68 that is sized to be received by ribs 60 such that rotation of inner shell causes cup 66 to correspondingly rotate. Cup 66 further includes an internal substantially cylindrical bore 70 forming a grooved ratchet chamber. Specifically, a track 73 defined by a plurality of axially extending arc-shaped grooves 71 (and corresponding cusp-shaped ridges 75 interposed between adjacent grooves 71) defines the outer periphery of chamber 70.

Chamber 70 is closed at its axially inner end by a base 72 having a circular aperture 74 extending centrally there through that is sized to loosely and rotatably pass shaft 22. A hexagonal cover 77 is provided and affixed to the axially outer end of bearing cup 66. Cover 77 is preferably transparent, and defines a central aperture 79 that matches aperture 74. As a result, rotation of shaft 22 does not directly cause bearing cup 66 and cover 77 to rotate.

Ratchet assembly 64 further includes a bearing carrier plate 76 having a generally cylindrical outer wall 81 having a diameter slightly less than the inner diameter of chamber 70. An aperture 85 extends axially through carrier plate 76, and defines a square or other suitable cross-section configured to snugly receive shaft 22 such that rotation of shaft 22 causes carrier plate 76 to rotate therewith. Specifically, outer wall 81 rides along grooves 71 as carrier plate 76 rotates within chamber 70 during operation.

A pair of opposing elongated rectangular cutouts forms pockets 78 in carrier plate 76 offset 180° with respect to each other. Each pocket 78 forms a driving face 80 and a second support wall 82 oriented perpendicular to driving face 80. Driving face 80 is elongated with respect to support wall 82. Each pocket 78 receives a ball 84 supported by one end of a compression spring 86 that is grounded at its other end by support wall 82. Each spring 86 biases its corresponding ball 84 against grooved track 73.

When a counterclockwise torque is applied to bearing cup 66, the force causes ridges 75 to bias ball 84 against the corresponding non-resilient driving face 80. The counterclockwise torque is thus transferred to carrier plate 76. Accordingly, bearing cup 66, carrier plate, and shaft 22 all rotate counterclockwise.

Figure 16:
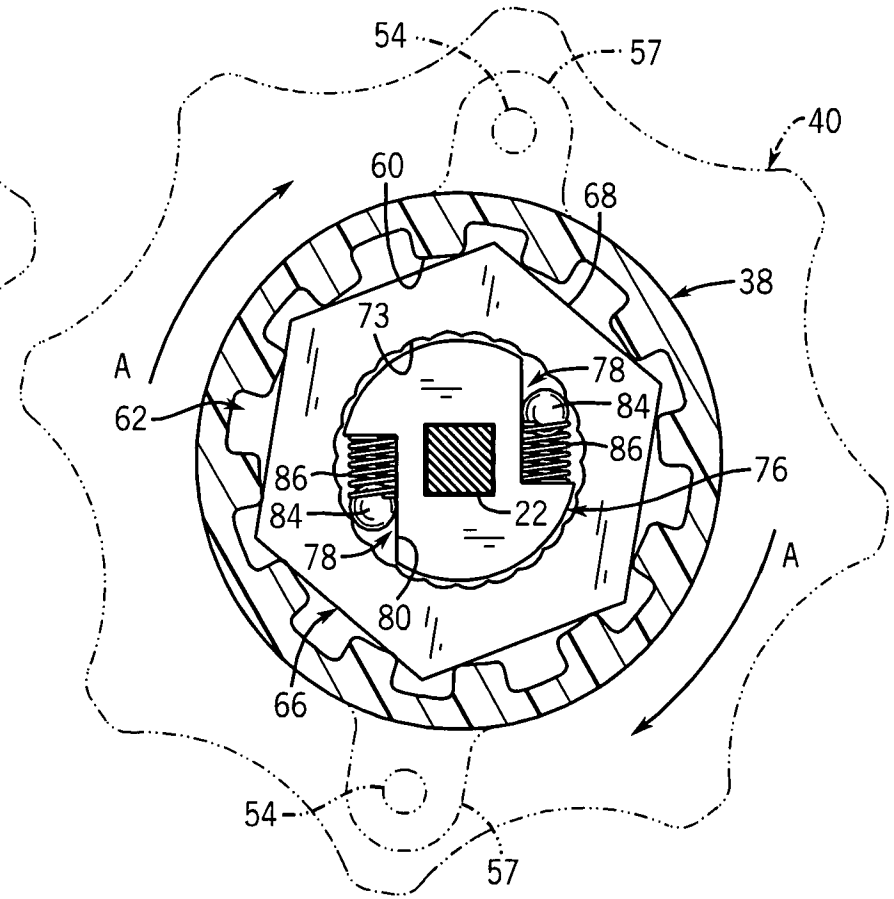
FIG. 16 is a sectional top elevation view of the uni-directional coupling mechanism similar to FIG. 15 as the operator assembly is rotated clockwise.

On the contrary, when a clockwise torque is applied to bearing cup 66 as indicated by Arrow A of FIG. 16, bearing cup 66 is caused to rotate clockwise. As bearing cup 66 rotates, the radial forces resulting from engagement between ball 84 and ridges 75 cause springs 86 to compress. The compression causes ball 84 to slide along driving face 80 as they cam over ridges 75 and fall into adjacent grooves 71 whose surfaces are defined by a radius that generally match the radius of ball 84. Ball 84 continues to ratchet along track 73 as carrier plate 76 continues to rotate clockwise.

Figure 21:
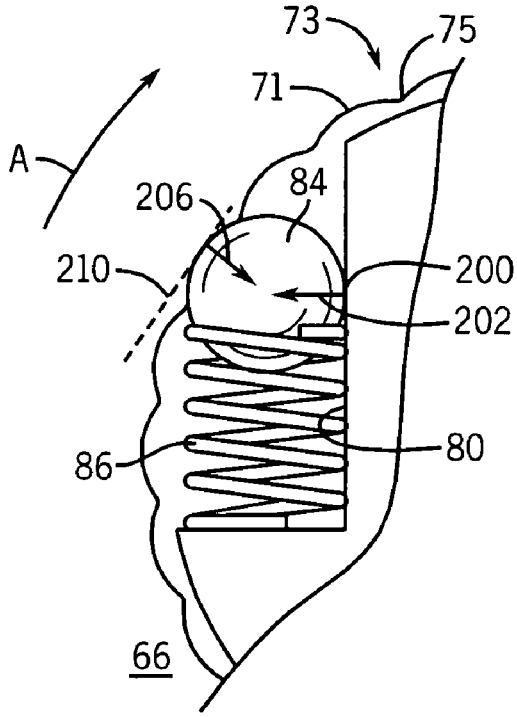
FIG. 21 is a fragmentary view of one ball of FIG. 20 showing forces on the ball when it is captured between the track and drive surface.
Figure 22:
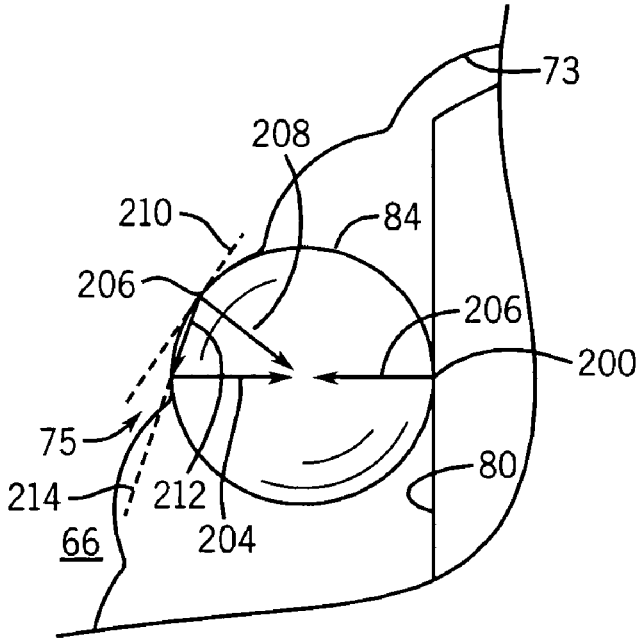
FIG. 22 is an enlarged view of FIG. 21 showing the vector components of the force between the ball and track such as includes a circumferential force operating to shear a ridge on the track.

Referring now to FIGS. 21 and 22, a clockwise force on the cup 66 indicated by arrow A causes the ball 84 to be compressed between the track 73 and the driving face 80. Because the driving face 80 is generally planar, it touches the ball 84 at a single contact point 200 to produce a normal force 202 on the ball 84 perpendicular to the surface of the driving face 80. As the ball 84 is captured, the track 73 must exert a countervailing force 204 on the ball 84 equal and opposite to the normal force 202.

In the case where the ball 84 contacts the track 73 at a single point 206, not necessarily along the line of normal force 202, the countervailing force 204 will be a vector component of a normal force 208 perpendicular to a tangent 210 of the track 73 at point 206. As a general mater, the tangent 210 will not be parallel to the driving face 80. A second vector component 212 will be directed circumferentially along a line 214 tending to urge the ball 84 against ridge 75. In cases where the line 214 of vector component 212 passes through a ridge 75 into the space between the track 73 and driving face 80, the risk of shearing off of the ridge 75 is created. This risk is increased by the concentration of pressure on the ridge 75 at a signal point by ball 84 as a result of the two dimensions of curvature of the ball 84 and single dimension of curvature of the track 73.

When the track 73 is such as to admit to an area of contact between the ball 84 and the track 73, the same analysis can be performed by assuming a single contact point 206 and normal force 208 being the weighted average of all contact points weighted by their contributed vectors.

Figure 23:
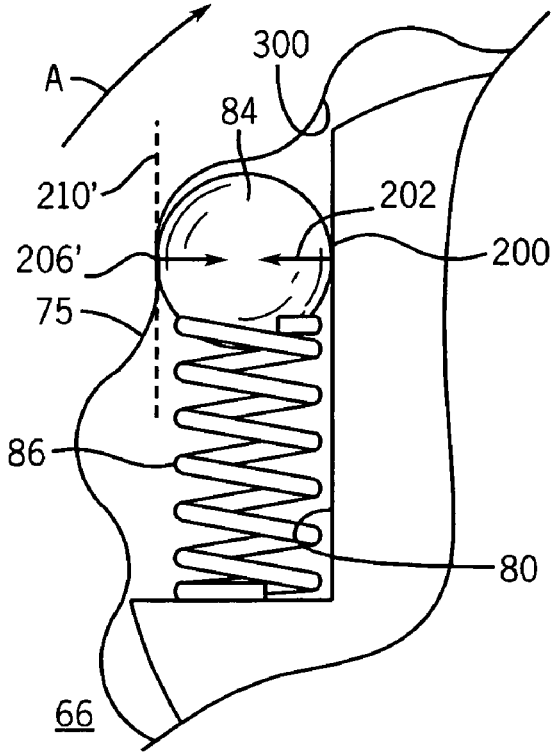
FIG. 23 is a figure similar to that of FIG. 21 showing an alternative track profile.
Figure 24:
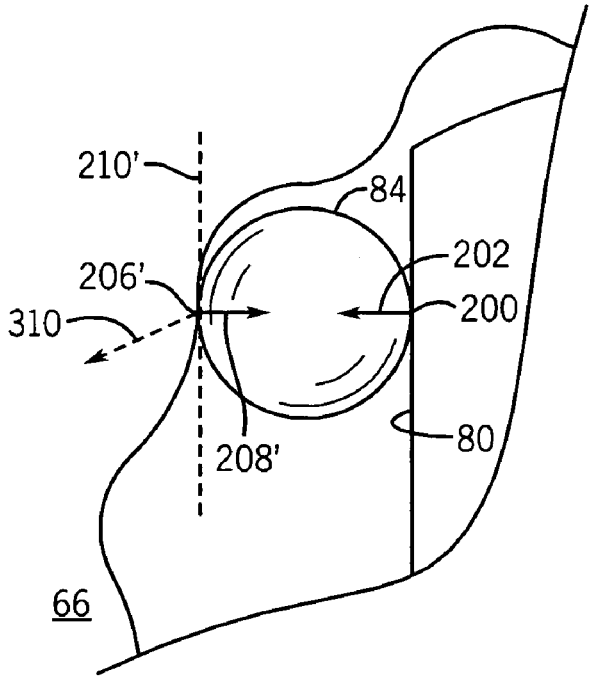
FIG. 24 is an enlarged view of FIG. 23 showing the absence of a vector component providing a circumferential force.

Referring now to FIGS. 23 and 24, in a second embodiment, a track 300 having a different shape will be used in which the contact point 206' between the ball 84 and the track 300 is opposite the contact point 200 between the ball 84 and the driving face 80 along the line of the normal force 202. Further, the tangent 210' at point 206' is parallel to the driving face 80. In this way, normal force 208' is directly opposite to force 203, and there is no circumferential force vector (per vector component 212 of FIG. 22) eliminating the application of shear forces on the ridges 75. For this reason, the ridges 75 can be rounded rather than cusp-shaped smoothing the passage of the ball 84 over the track 300 when clockwise rotation is effected. While this parallel orientation of the tangent 210' and driving face 80 is preferred, it will be noted that a small component vector of force 310 may be allowable as long as it is directed into the body of the cup 66 and not across a ridge 75.

Figure 17:
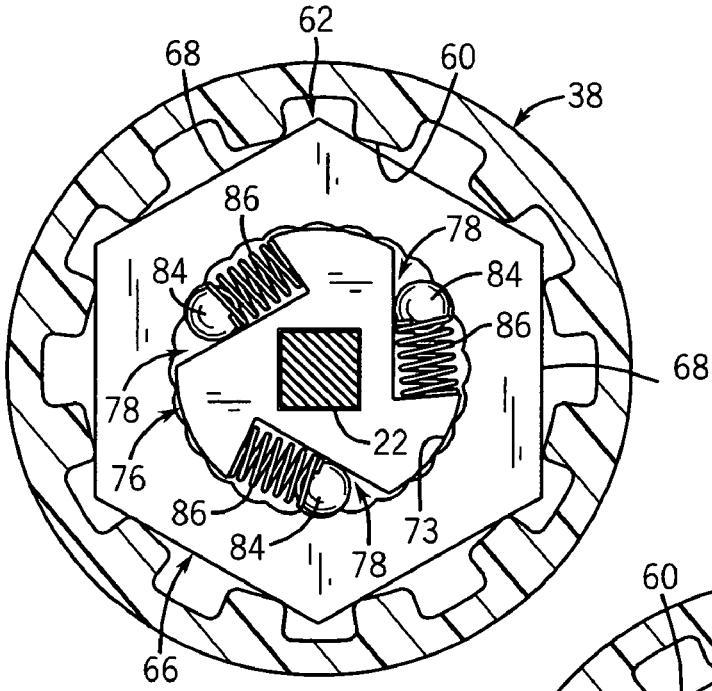
FIG. 17 is a top plan view of a uni-directional coupling mechanism constructed in accordance with an alternative embodiment.
Figure 18:
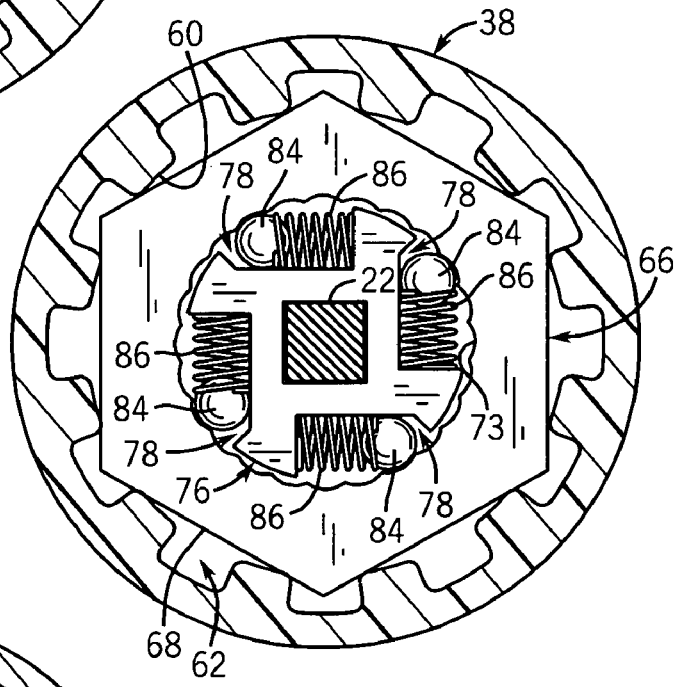
FIG. 18 is a top plan view of a uni-directional coupling mechanism constructed in accordance with another alternative embodiment.
Figure 19:
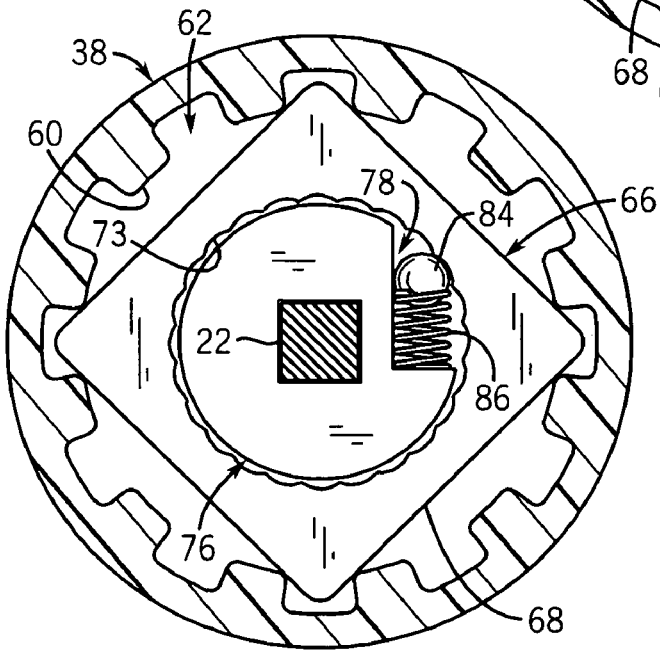
FIG. 19 is a top plan view of a uni-directional coupling mechanism constructed in accordance with still another alternative embodiment.

Referring now to FIGS. 17-19, ratchet assembly 64 is illustrated in accordance with several alternative embodiments having any number of pockets 78 formed in carrier plate 76. Specifically, as illustrated in FIG. 17, three pockets 78 can be oriented 120° with respect to each other in carrier plate 76. Because an additional pocket 78 is provided and an additional ball 84 engages track 73, additional torque is required to cause each ball 84 to slide along track 73 as bearing cup 66 is rotated counterclockwise. The required amount of driving torque can be increased still by providing four pockets 78 oriented 90° with respect to each other as illustrated in FIG. 18. Alternatively, the required amount of driving torque can be decreased by providing a single pocket 78 as illustrated in FIG. 19. FIG. 19 further illustrates bearing cup outer wall 68 as being square-shaped and sized to engage ribs 60 in accordance with one of several alternative configurations of outer wall 68 intended to fall within the scope of the present invention.

Figure 20:
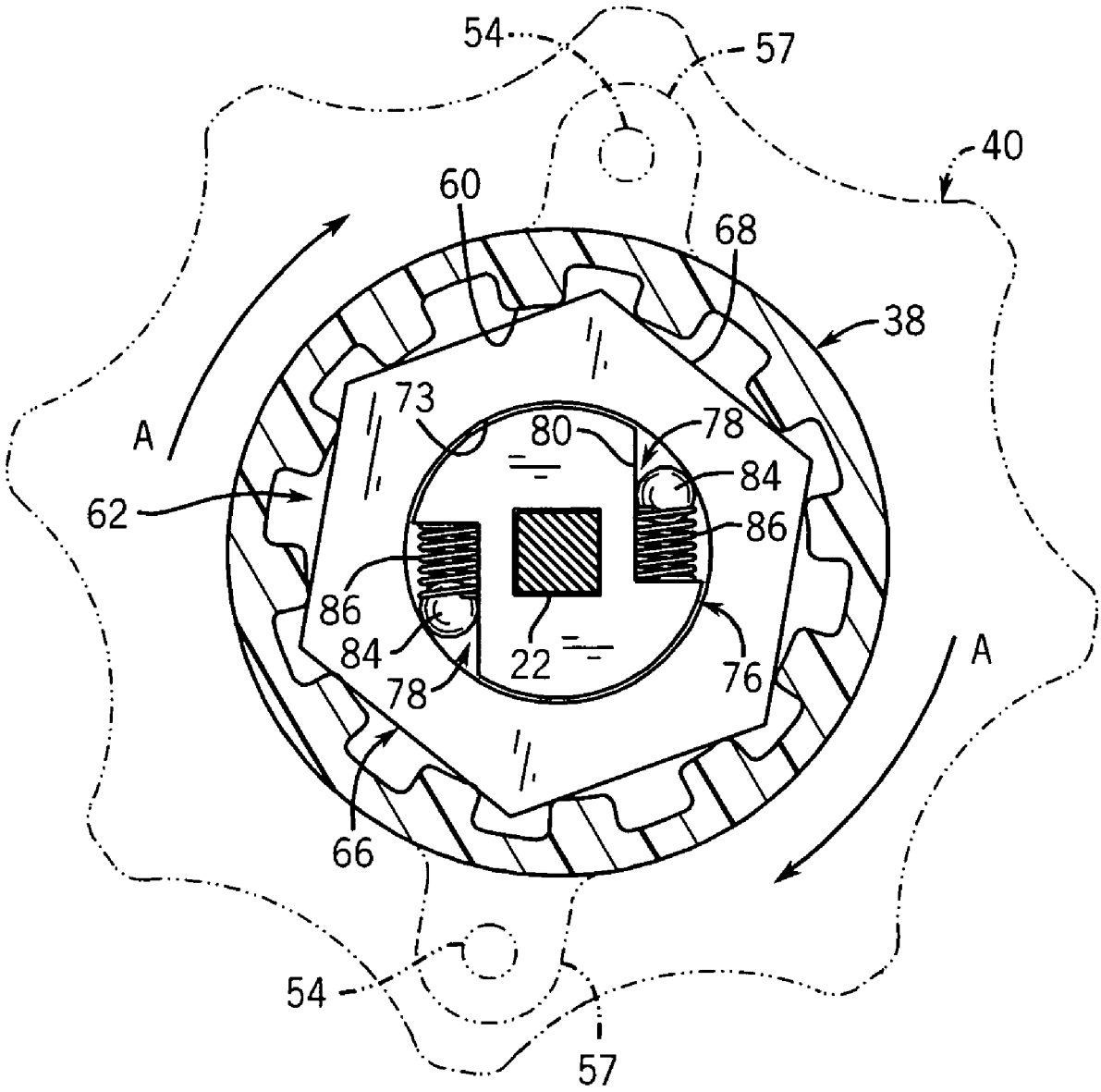
FIG. 20 is a top plan view of a uni-directional coupling mechanism constructed in accordance with yet another alternative embodiment.

Referring to FIG. 20, bearing cup 66 can be provided with a track 73 having a smooth surface as an alternative to grooves 71. Because the frictional resistance imparted onto ball 84 by smooth track 73 is reduced, the torque necessary to rotate bearing member 83 along track 73 is also reduced with respect to the grooved track described above. Furthermore, because a line extending tangentially to smooth track 73 at a location adjacent ball 84 intersects a line extending along driving face 80, ball 84 will engage track 73 when a counterclockwise torque is applied to bearing cup 66, thereby rotatably coupling bearing cup 66 and carrier plate 76.

Figure 8:
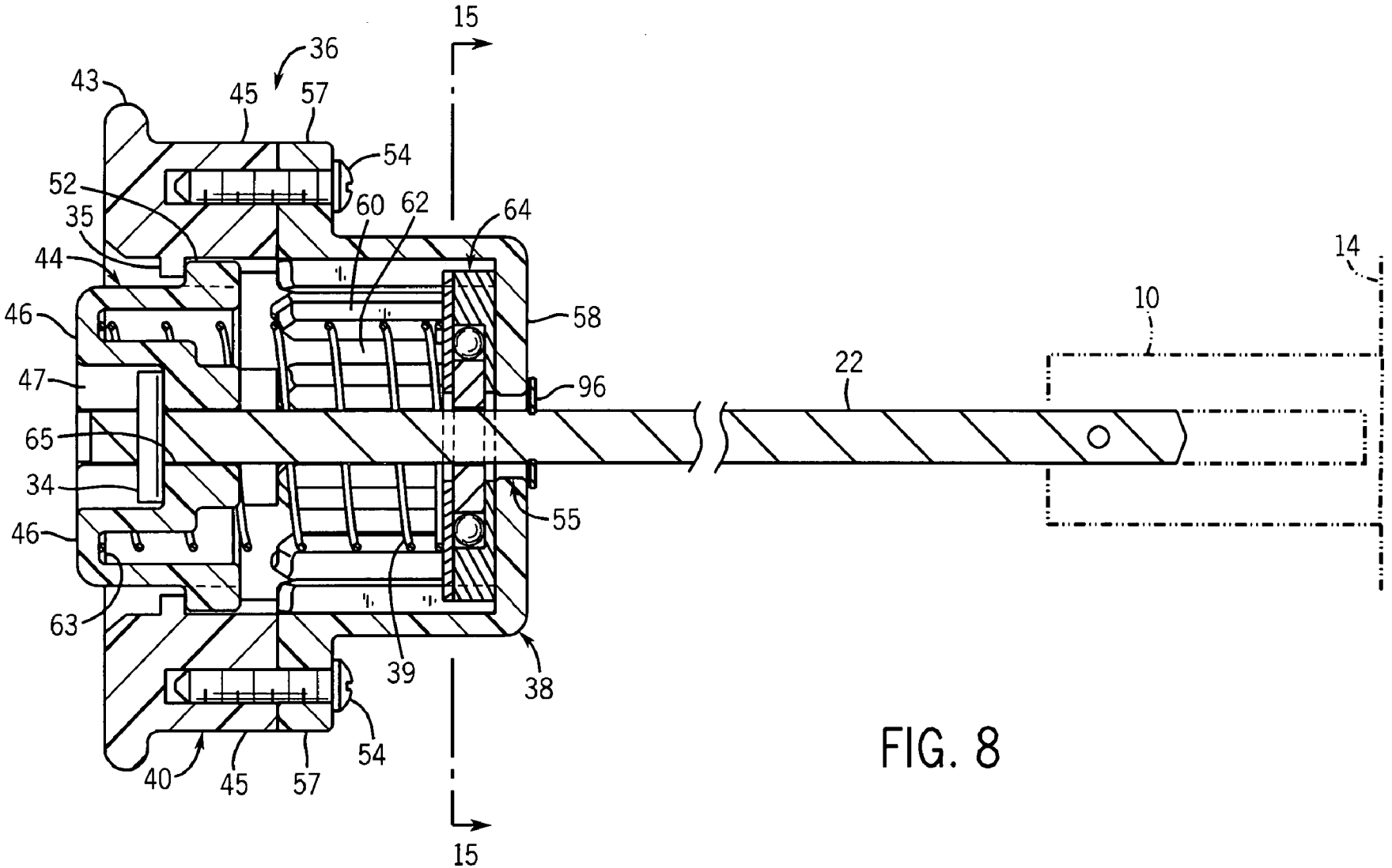
FIG. 8 is a sectional side elevation view of the operator assembly in the position illustrated in FIG. 6.

Referring now to FIGS. 5 and 8, hub 44 includes a generally cylindrical body 50 defining an internal seat that receives one end of a coil spring 39 that is seated at its opposite end against the outer axial surface of cover 77. Spring 39 is a compression spring that provides a force biasing hub 44 axially out towards handle 40.

Cylindrical body 50 is closed at one end by an axially front face 46 sized to be engaged by connector 28. Accordingly, when door 24 is closed, connector 28 depresses hub 44 against the force of spring 39.

An aperture 65 extends axially through hub 44, and defines a square cross-section configured to snugly receive shaft 22 such that rotation of hub 44 causes shaft 22 to also rotate. It should be easily appreciated, however, that shaft 22 and aperture 65 (along with the other shaft-engaging components) could assume any alternative cross-sectional shape without departing from the present invention. The axially outer end of aperture 65 defines a keyway 47 extending only partially into hub 44 sized to receive a pin 34 extending transverse from the axially outer end of shaft 22. Shaft 22 and hub 44 thus rotate in concert while keyway 47 prevents shaft 22 from being pulled through hub 44.

Figure 12:
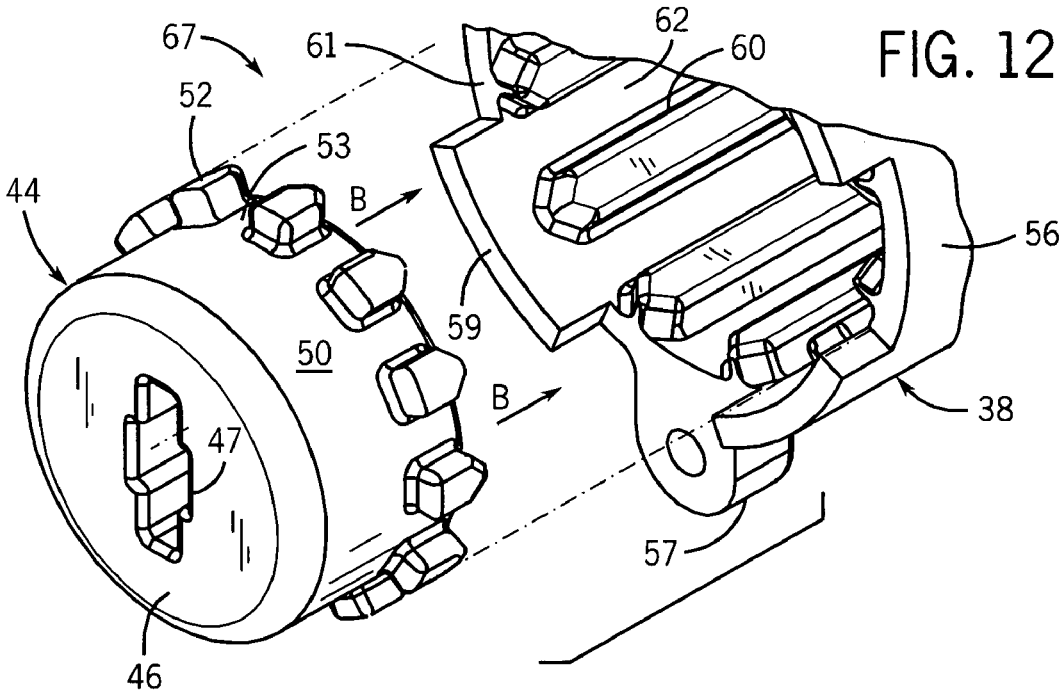
FIG. 12 is an assembly view of the operator assembly illustrating a bi-directional coupling mechanism.
Figure 13:
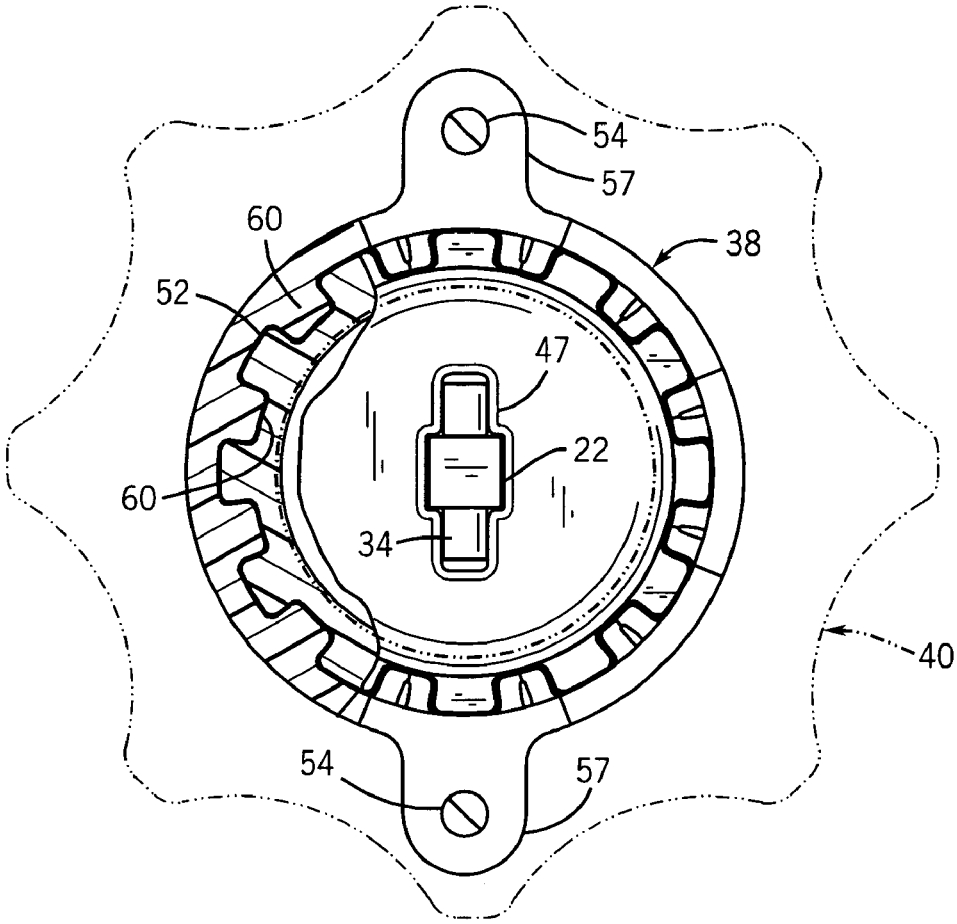
FIG. 13 is a partial sectional elevation view of the operator assembly showing the bi-directional coupling mechanism taken along line 13-13 of FIG. 9.
Figure 14:
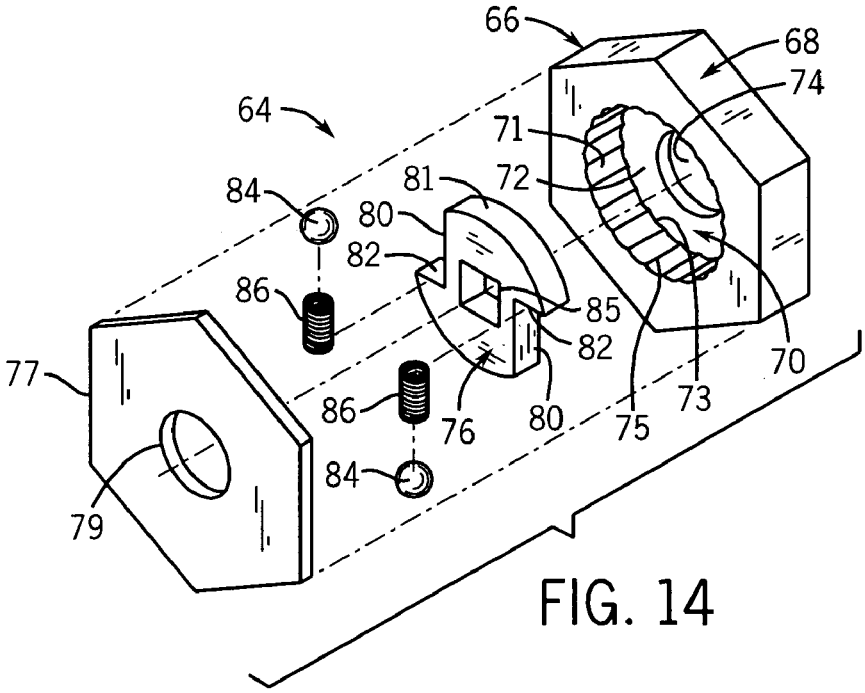
FIG. 14 is an assembly view of a uni-directional coupling mechanism.

Referring also to FIGS. 12 and 13, a bi-directional coupling mechanism 67 includes a plurality of beveled pawls 52 extending radially out from the axially inner end of body 50 and are equally spaced circumferentially about body 50 to define interposed recesses 53 that are sized to receive ribs 60. Likewise, pawls 52 are received by recesses 62. It will thus be appreciated that the diameter defined by opposing recesses 62 is slightly greater than the diameter defined by opposing pawls 52, and the diameter defined by opposing ribs 60 is slightly greater than the diameter defined by opposing recesses 53 but less than the diameter formed by opposing pawls 52. Coupling mechanism 67 is engaged and disengaged by clutch 43 as hub 44 is depressed and released, respectively, relative to shell 38, as is described in more detail below.

When bi-directional coupling mechanism 67 is engaged, pawls 52 and ribs 60 interlock hub 44 and shell 38 with respect to rotation. Accordingly, rotation of operator assembly 36, and in particular shell 38, in both the clockwise and counterclockwise directions causes hub 44 and shaft 22 to correspondingly rotate.

Referring again to FIG. 5, handle 40 is defined by an axially extending annular neck 48 that is connected at its outer end to a fluted grip 42 extending radially out from the axially outer end of handle 40. Grip is thus configured to be intuitively engaged by the hand of a user to rotate operator assembly 36 in the clockwise and counterclockwise directions, selectively causing an internal fuse block switch (not shown) to connect and disconnect, respectively, power in fuse block 10. It should be appreciated, however, that these directions of rotation can be reversed as desired to connect and disconnect the power.

A plurality of radially spaced notches 49 are formed in the axially inner end of neck 48, and are equally spaced circumferentially about neck 48, to define a corresponding plurality of locking teeth 51 interposed between adjacent notches 49. Teeth 59 and recesses 61 of shell 38 are configured to interlock with teeth 51 and notches 49, respectively, of handle 40. A pair of threaded apertures 45 extends axially into grip 42 and face corresponding mounting flanges 57. Screws 54 thus extend through flanges 57 and into apertures 45 to secure handle 40 to shell 38.

Figure 10:
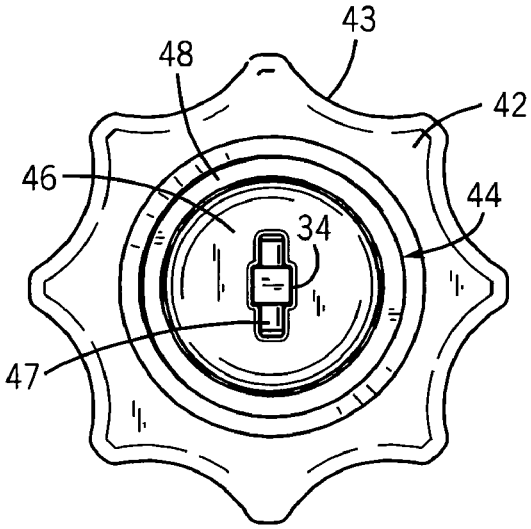
FIG. 10 is a top plan view of the operator assembly illustrated in FIG. 3.

Referring also to FIG. 10, annular neck 48 defines an inner diameter sized to receive cylindrical hub 44. An annular flange 35 extends radially in from neck 48 that is sized sufficiently large to receive cylindrical body 50 of hub 44, but is sufficiently small to abut the axially outer edges of pawls 52. Flange 35 thus provides a stop that prevents hub 44 from sliding through handle 40 during operation while enabling relative rotation between handle 40 and hub 44 (i.e., when bi-directional coupling mechanism 67 is disengaged).

System Operation

Figure 6:
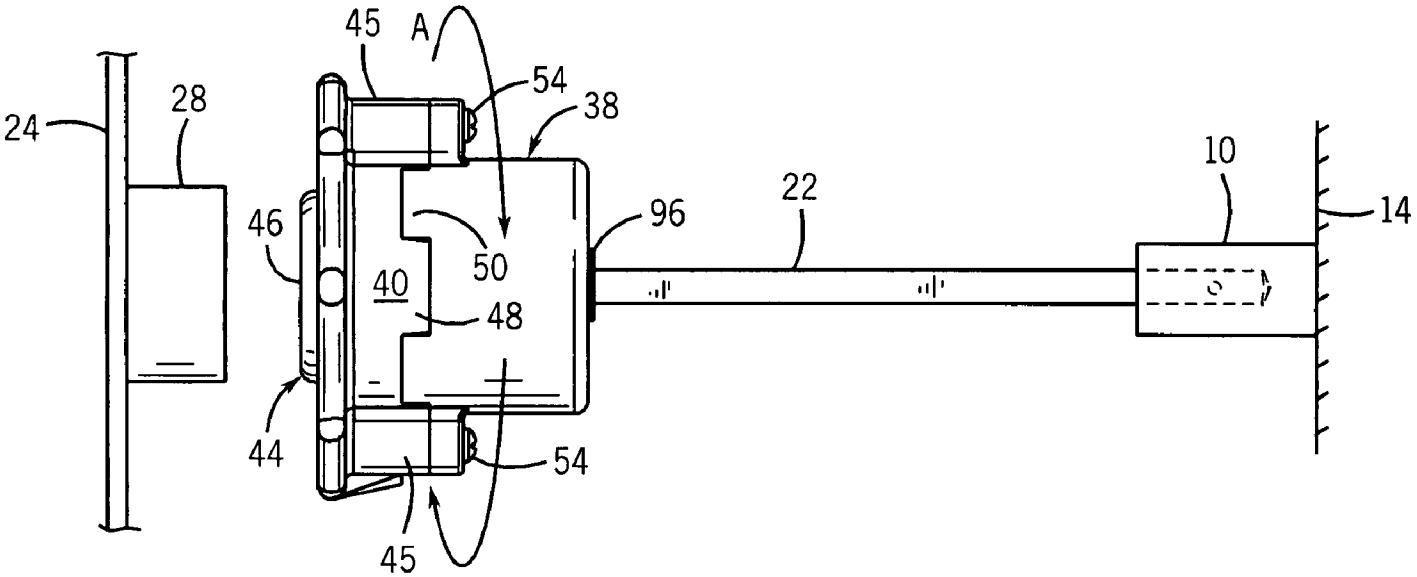
FIG. 6 is a side elevation view of the operator assembly illustrated in FIG. 3 when the door is open.

Operation of operator assembly 36 will now be described with initial reference to FIGS. 6 and 8 illustrating door 24 in an open position and hub 44 in its normal position biased outwards by spring 39. In this position, pawls 52 are axially displaced and disengaged from ribs 60, thus illustrating bi-directional coupling mechanism 67 in a disengaged position. As a result, when a user rotates operator assembly 36 (e.g., via handle 40), the disengaged coupling mechanism 67 does not cause shaft 22 to correspondingly rotate.

Figure 15:
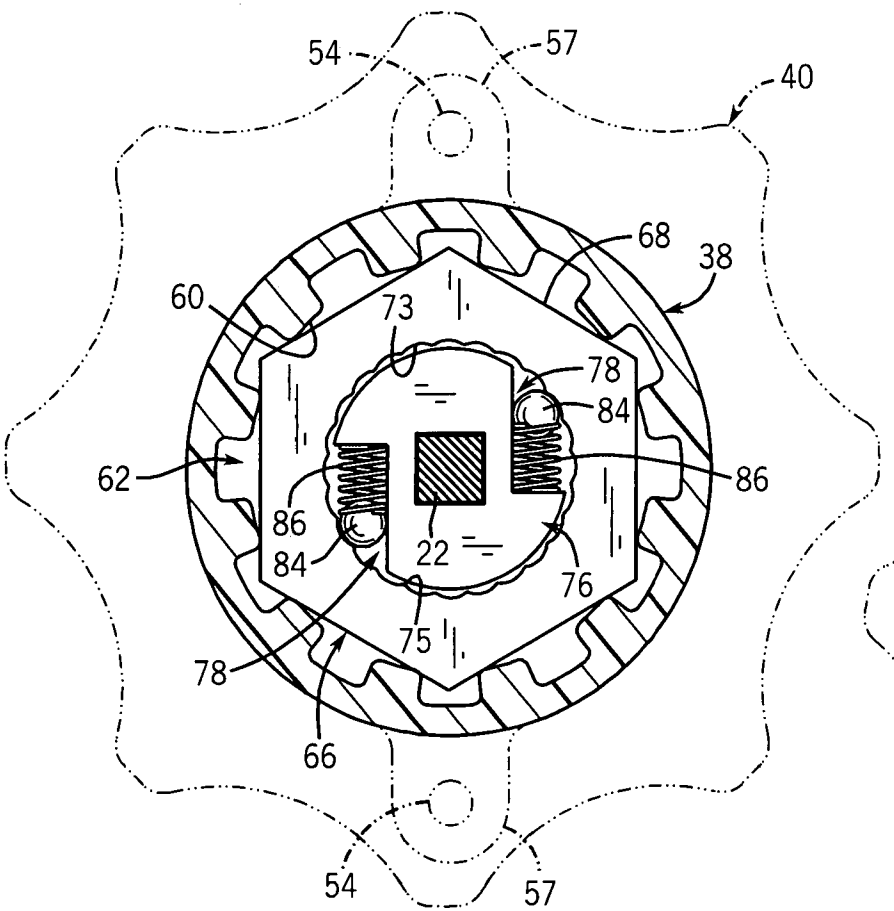
FIG. 15 is a sectional top elevation view of the uni-directional coupling mechanism illustrated in FIG. 14.

Rather, referring to FIGS. 15 and 16, uni-directional ratchet assembly 64 operates as described above. Specifically, when a user applies a torque to operator assembly 36 in the counterclockwise direction, for example via handle 40 (i.e., in an attempt to disconnect power in fuse block 10), inner shell ribs 60 impart a corresponding counterclockwise force onto bearing cup 66 which, in turn, causing ball 84 to engage grooved track 73 and rotatably couple bearing cup 66 and carrier plate 76. Accordingly, counterclockwise rotation of operator assembly 36 causes carrier plate 76 (and shaft 22) to correspondingly rotate, thus allowing power to be disconnected in fuse block 10.

On the contrary, when a torque is applied to operator assembly 36 in the clockwise direction (i.e., in an attempt to connect power in fuse block 10), bearing member(s) 84 compress corresponding spring(s) 86 and ratchet along track 73. Accordingly, bearing cup 66 rotates about carrier plate 76 (and shaft 22), thus preventing power from being reconnected in fuse block 10. Furthermore, because operator assembly 36 is allowed to freely rotate in the clockwise direction, uni-directional ratchet assembly 64 provides tactile feedback that power is not permitted to be connected to fuse block 10 by simply rotating operator assembly 36. Moreover, if the user is attempting to disconnect power from fuse block 10, ratchet assembly 64 induces the user to rotate operator assembly 36 in the opposite, and correct, direction.

The present inventors have recognized that certain internal disconnect switches in fuse block 10 are configured to operate under a low amount of torque. The amount of torque necessary to cause ball 84 to ratchet along track 73 can be controlled at each individual pocket 78, for example, by adjusting the spring constant of spring 86, the geometric configuration of ridges 75, and the size of ball 84. Alternatively, the driving torque force can be controlled by the number of pockets 78 formed in carrier plate 76 as described above. Advantageously, the amount of torque necessary to cause ball 84 to ratchet along track 73 is less than the amount of torque necessary to operate the disconnect switch.

Figure 7:
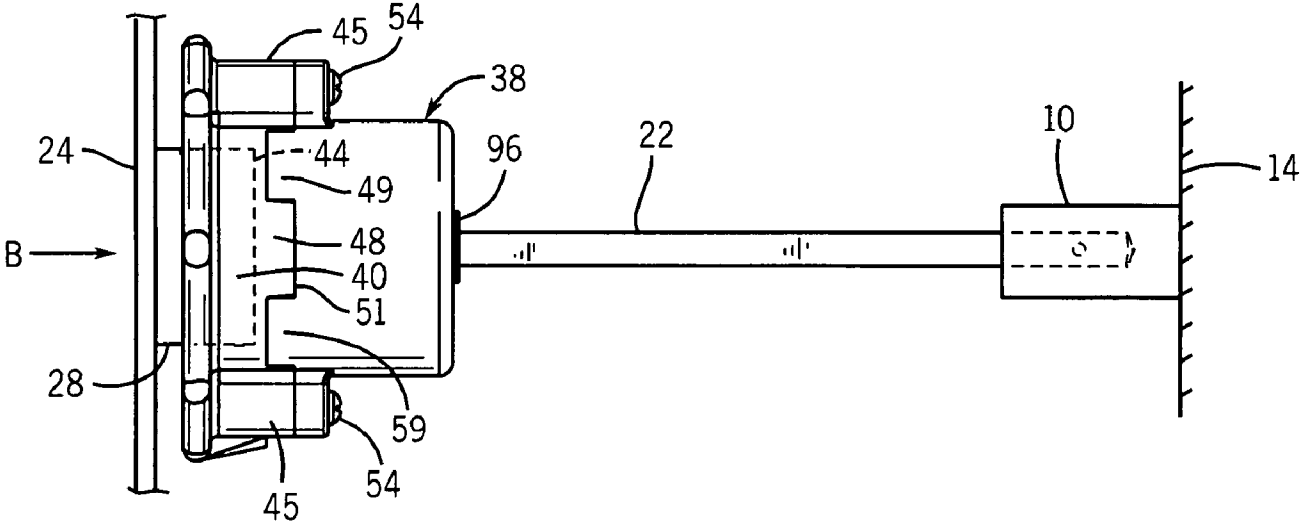
FIG. 7 is a side elevation view of the operator assembly illustrated in FIG. 3 when the door is closed.
Figure 9:
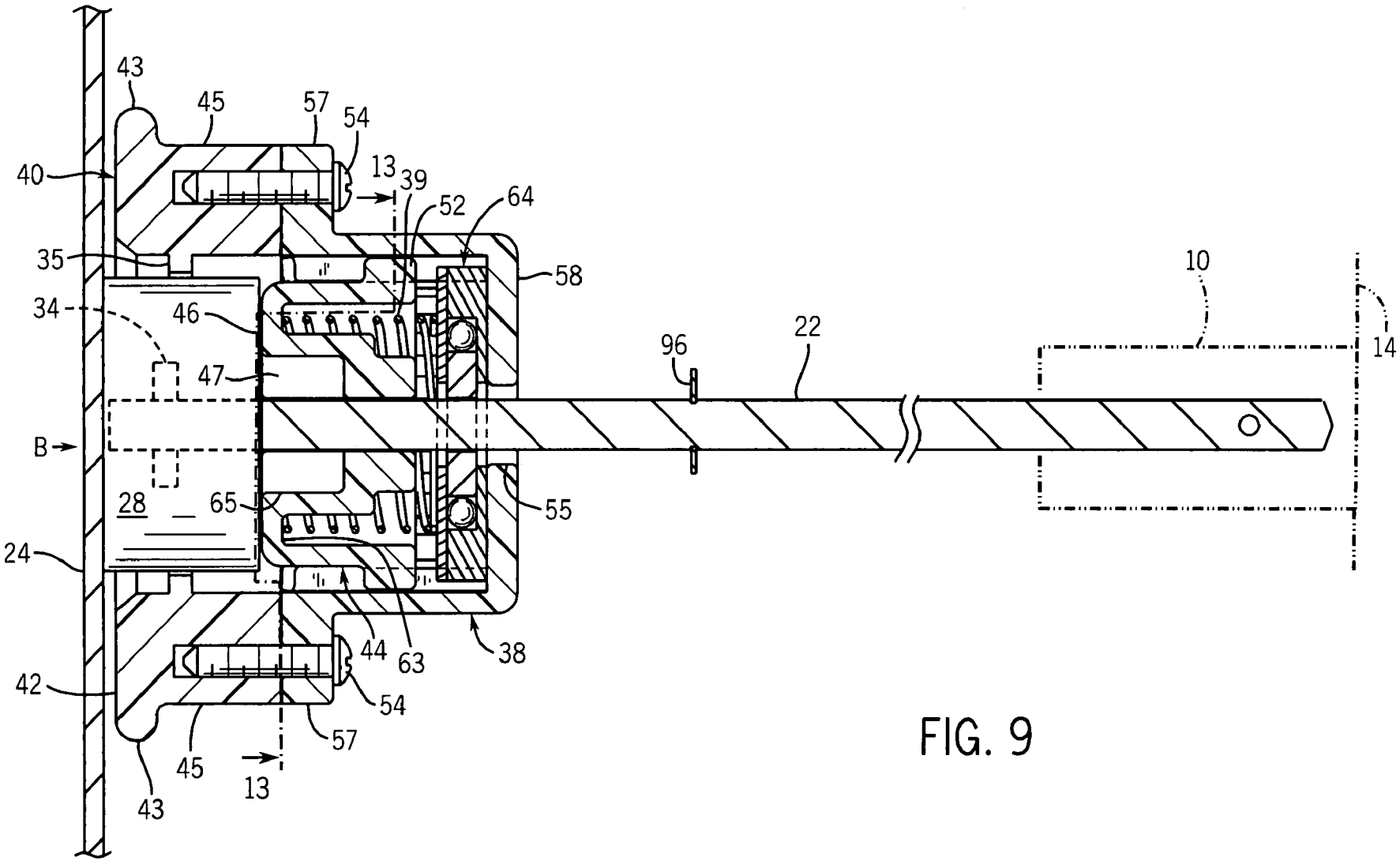
FIG. 9 is a sectional side elevation view of the operator assembly in the position illustrated in FIG. 7.

Referring now to FIGS. 7, 9, and 12, bi-directional coupling mechanism 67 can be engaged in one of two ways. First, door 24 can be closed, thus causing connector 28 to depress hub 44 relative to inner shell 38 against the biasing forces of spring 39 as indicated by Arrow B. Secondly, bi-directional coupling mechanism 67 can be engaged by manually depressing hub 44 relative to operator assembly 36 by either depressing hub 44 directly, or by pulling handle 40 out, thus raising inner shell 38 relative to hub 44. Whether door 24 is closed or hub 44 is manually depressed relative to shell 38, pawls 52 become interdigitated with ribs 60 thus rotatably interlocking hub 44 and operator assembly 36. The beveled ends of teeth 51 and ribs 60 assist in engaging coupling mechanism 67. Because shaft 22 is coupled to hub 44, when operator assembly 36 is rotated clockwise and counterclockwise with bi-directional coupling mechanism 67 engaged, shaft 22 rotates along with operator assembly 36 causing power to be connected and disconnected, respectively.

It is thus appreciated that when door 24 is closed and a user wishes to access fuse block 10, the user actuates knob 26, which causes operator assembly 36 to rotate counterclockwise, thereby disconnecting power from fuse block 10. Once door 24 is open (disconnecting bi-directional coupling mechanism 67) and operator assembly 36 is rotated clockwise, uni-directional ratchet assembly 64 will prevent shaft 22 from reconnecting power in fuse block 10. Rather, the user must first perform a predetermined sequence of events by manually depressing hub 44 relative to shell 38 in order to reengage bi-directional coupling mechanism 67. While hub 44 is depressed, operator assembly 36 can be rotated clockwise to reconnect power in fuse block 10.

The invention has been described in connection with what are presently considered to be the most practical and preferred embodiments. However, the present invention has been presented by way of illustration and is not intended to be limited to the disclosed embodiments. For example, while the present invention is applicable to fuse blocks of the type described above, it should be appreciated that the present invention is applicable to any handle-operated device that would benefit from ratchet assembly 64 and coupling mechanism 67. Accordingly, those skilled in the art will realize that the invention is intended to encompass all modifications and alternative arrangements included within the spirit and scope of the invention, as set forth by the appended claims.

We claim:

1. A ball ratchet comprising:

an inner element rotatable within an outer element;

a first substantially circular track formed in one of the inner and outer elements providing a set of ridges extending radially toward an other of the inner and outer elements;

a driving face formed in the other of the inner and outer elements and facing the circular track;

at least one spring-loaded ball fitting between the driving face and the circular track so that (1) rotary force between the inner and outer elements in a first direction causes movement of the at least one spring-loaded ball to compress the spring allowing the at least one ball to navigate between the ridges and the driving face to permit relative movement of the inner and outer elements; and (2) rotary force between the inner and outer elements in a second direction causes capture of the at least one spring-loaded ball between the circular track and the driving face locking the inner and outer elements for joint movement;

wherein a vector of force by the at least one ball on the circular track does not pass over or through one of the ridges so that a shearing of the ridge would permit rotation in the second direction.

2. The ball ratchet of claim 1 wherein tangent lines to contact points of the at least one ball on the inner and outer elements when the at least one ball is captured between the inner and outer elements are parallel.

3. The ball ratchet of claim 1 wherein the circular track is on the outer element.

4. The ball ratchet of claim 1 wherein the outer element is a handle graspable by a human operator to turn the outer element.

5. The ball ratchet of claim 1 wherein the inner element includes a keyed bore for receiving a shaft.

6. The ball ratchet of claim 1 further including an electrical disconnect attached to the inner element wherein the ball ratchet allows disconnect of the electrical disconnect through the ball ratchet by turning the outer element, and prevents connection of the electrical disconnection through the ball ratchet by turning the outer element for at least one operating position of the outer element.

7. The ball ratchet of claim 1 wherein the ridges present continuously rounded surfaces.

8. The ball ratchet of claim 1 including two spring-loaded balls symmetrically located about the inner element.

9. The ball ratchet of claim 1 wherein the vector of force by the at least one ball on the circular track does not pass into a space between the first and second elements.

10. An operator assembly for controlling a disconnect having a rotary shaft receiving a portion of a door-mounted knob and rotating in a first direction to connect electrical current through the disconnect, and rotating in a second direction to prevent electrical current from flowing through the disconnect, the operator assembly further comprising:

a handle configured to receive the rotary shaft, and a uni-directional coupling mechanism that is connected between the shaft and the handle, wherein the uni-directional coupling mechanism facilitates uni-directional rotation of the shaft in response to rotation of the operator assembly and wherein the uni-directional coupling further comprises:

an inner element rotatable within an outer element;

a first substantially circular track formed in one of the inner and outer elements providing a set of ridges extending radially toward an other of the inner and outer elements;

a driving face formed in the other of the inner and outer elements and facing the circular track;

at least one spring-loaded ball fitting between the driving face and the circular track so that (1) rotary force between the inner and outer elements in a first direction causes movement of the at least one spring-loaded ball to compress the spring allowing the at least one ball to navigate between the ridges and the driving face to permit relative movement of the inner and outer elements and (2) rotary force between the inner and outer elements in a second direction causes capture of the at least one spring-loaded ball between the circular track, and the driving face locking the inner and outer elements for joint movement;

wherein a vector of force by the at least one ball on the circular track does not pass through one of the ridges and then into space between the first and second elements so that a shearing of the ridge does not permit rotation in the second direction.

11. The operator assembly of claim 10 wherein tangent lines to contract points of the at least one ball on the inner and outer elements when the at least one ball is captured between the inner and outer elements are parallel.

12. The operator assembly of claim 10 wherein the circular track is on the outer element.

13. The operator assembly of claim 10 wherein the ridges present continuously rounded surfaces.

14. The operator assembly of claim 10 including two spring-loaded balls symmetrically located about the inner element.

15. The operator assembly of claim 10 wherein the vector of force by the at least one ball on the circular track does not pass into the space between the first and second elements.

* * * * *